US006250070B1

(12) United States Patent
Kreiner et al.

(10) Patent No.: US 6,250,070 B1
(45) Date of Patent: Jun. 26, 2001

(54) ION THRUSTER WITH ION-EXTRACTION GRIDS HAVING COMPOUND CONTOUR SHAPES

(75) Inventors: Kurt B. Kreiner, Rancho Palos Verdes; John R. Beattie, Westlake Village; Alois Wittmann, Palos Verdes; Lewis S. Pilcher, El Segundo, all of CA (US)

(73) Assignee: Hughes Electronics Corporation, El Segundo California ( * ) Notice: Subject to any disclaimer, the term of this patent is extended or adjusted under 35 U.S.C. 154(b) by 0 days.

(21) Appl. No.: 09/569,708

(22) Filed: May 9, 2000

(51) Int. Cl.[7] ..... F03H 1/00; H05H 1/00
(52) U.S. Cl. ..... 60/202; 313/360.1
(58) Field of Search ..... 60/202; 313/360.1, 313/359.1, 361.1, 362.1; 315/111.81

(56) References Cited

U.S. PATENT DOCUMENTS 3,702,416 * 11/1972 Bex et al. ..... 315/111.81
3,793,550 * 2/1974 Thompson, Jr. ..... 313/360.1
4,731,558 * 3/1988 Haisma et al. ..... 313/478
4,879,518 * 11/1989 Broadhurst ..... 313/360.1
5,689,950 * 11/1997 Smith ..... 60/202
5,924,277 * 7/1999 Beattie et al. ..... 60/202

* cited by examiner

*Primary Examiner*—Ted Kim
(74) *Attorney, Agent, or Firm*—T. Gudmestad

(57) ABSTRACT

An ion thruster has a source of a plasma, and an ion-optics system located in sufficient proximity to the source of the plasma to extract ions therefrom. The ion-optics system includes at least two grids arranged in a facing-but-spaced-apart relationship to each other, with each grid being axi-symmetric about a grid axis. Each grid includes a peripheral region defining a grid plane perpendicular to the grid axis, a first region of curvature adjacent to the peripheral region, and a second region of curvature along the grid axis such that the first region of curvature lies between the second region of curvature and the peripheral region. The first region of curvature is a convexly curved segment of a first sphere relative to the grid plane, and the second region of curvature is a concavely curved segment of a second sphere relative to the grid plane.

18 Claims, 3 Drawing Sheets

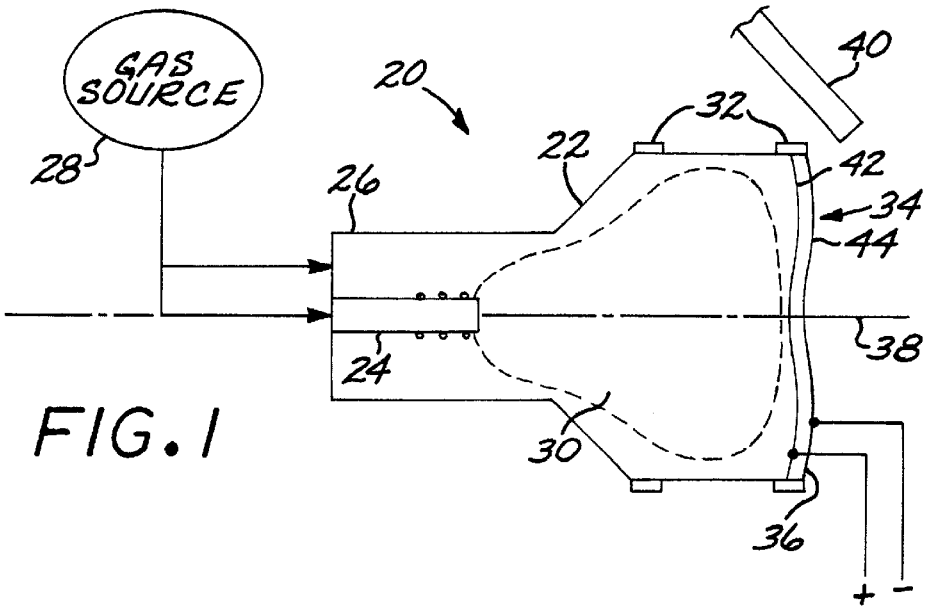
FIG. 1
FIG. 3
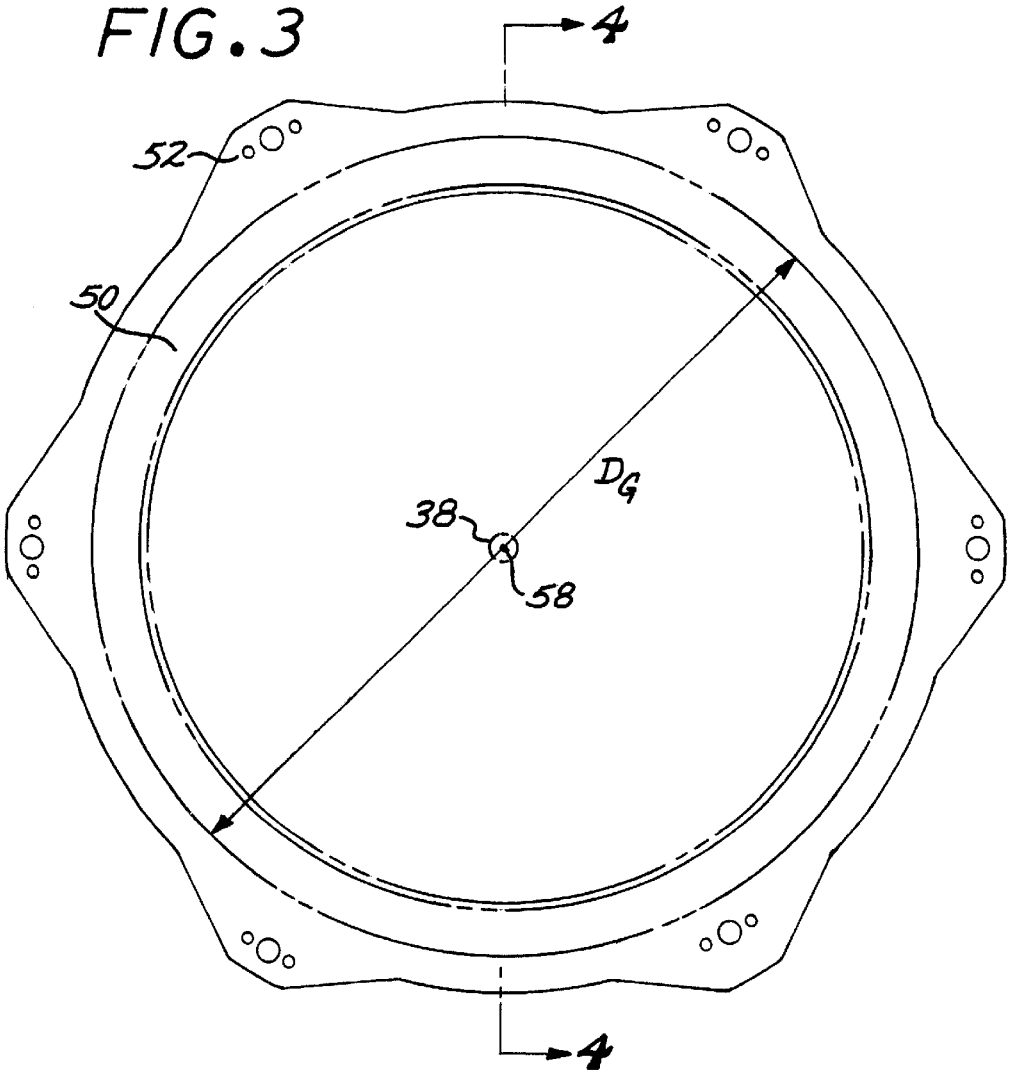

ION THRUSTER WITH ION-EXTRACTION GRIDS HAVING COMPOUND CONTOUR SHAPES

BACKGROUND OF THE INVENTION

This invention relates to ion thrusters and, more particularly, to the shapes of the grids used in the ion-optics system of the ion thruster.

Ion thrusters are used in spacecraft such as communications satellites for stationkeeping and other functions. An important advantage of the ion thruster over an engine using chemical propellants is that it utilizes the electrical power generated by the solar cells of the satellite to achieve the propulsion. The ion thruster has a high specific impulse, making it an efficient engine which requires very little propellant. Since the ion thruster requires relatively small amounts of the consumable propellant that is ionized, it is therefore not necessary to lift large masses of chemical fuel to orbit.

In an ion thruster, a plasma is created and confined within the body of the thruster. Ions from the plasma are electrostatically accelerated rearwardly by an ion-optics system. The reaction with the spacecraft drives it forwardly, in the opposite direction. The force produced by the ion thruster is relatively small. The ion thruster is therefore operated for a relatively long period of time to impart the required momentum to the heavy spacecraft. For some missions the ion thruster must be operable and reliable for thousands of hours of operation, and with multiple starts and stops.

The ion-optics system includes grids to which appropriate voltages are applied in order to accelerate the ions rearwardly. The grids are in a facing orientation to each other, spaced apart by relatively small clearances such as about 0.035 inches at room temperature. The grids include aligned apertures therethrough. Some of the ions accelerated by the applied voltages pass through the apertures, providing the propulsion. Others of the ions impact the grids, heating them and etching away material from the grids by physical sputtering. The heating and electrostatic forces on the grids combine to cause substantial mechanical forces at elevated temperature on the grids, which distort the grids unevenly. The uneven distortion of the grids causes adjacent grids to physically approach each other, rendering them less efficient and prone to shorting against each other. These effects are taken into account in the design of the grids and the operation of the ion thruster, so that the thruster remains functional for the required extended lifetimes. However, limitations may be placed on the operation of the ion thruster because of grid distortion, such as a relatively slow ramp-up in power during startup and operation, so that the adjacent grids do not expand so differently that they come into contact.

At the present time, the grids are usually made of molybdenum formed into a domed shape. The molybdenum resists material removal by physical sputtering. The domed shape establishes the direction of change due to thermal expansion and aids in preventing a too-close approach of the adjacent grids as a result of differences in temperatures of the adjacent grids. While the available grids are operable in current engines, it is expected that uneven expansion of the grids may limit the extension of ion thrusters to larger sizes and higher power ranges, as well as to certain desired operating ranges such as rapid start-up and acceleration.

Accordingly, there is a need for a better approach to the grids used in the ion-optics systems of ion thrusters. The present invention fulfills this need, and further provides related advantages.

SUMMARY OF THE INVENTION

The present invention provides an ion thruster whose grids have an improved structure. The grids are shaped so that they maintain a desired clearance between the adjacent grids during both transient and steady-state conditions. An overly close approach of the grids and failure by shorting due to contact between adjacent grids are avoided. With these grids, the ion thrusters may be built to produce larger power outputs in smaller volumes than previously possible. They may also be started and adjusted in power output more quickly.

In accordance with the invention, an ion thruster comprises a source of a plasma, and an ion-optics system located in sufficient proximity to the source of the plasma to extract ions therefrom along a thrust axis. The ion-optics system comprises at least two grids arranged in a facing-but-spaced-apart relationship to each other. In some designs of particular interest, there are exactly two grids and in other designs there are exactly three grids. Each grid comprises a peripheral region defining a grid plane perpendicular to the thrust axis, a first region of curvature adjacent to the peripheral region, and a second region of curvature along the thrust axis such that the first region of curvature lies between the second region of curvature and the peripheral region. The first region of curvature is convexly curved relative to the grid plane, and the second region of curvature is concavely curved relative to the grid plane. There may be additional regions of curvature, such as an intermediate region joining the first region and the second region.

Desirably, the first region of curvature is a segment of a first sphere, and/or the second region of curvature is a segment of a second sphere. In this embodiment, the first sphere has a first-sphere radius of curvature and a first-sphere center lying along the thrust axis at a first-sphere distance from the grid plane, and the second sphere has a second-sphere radius of curvature and a second-sphere center lying along the thrust axis at a second-sphere distance from the grid plane. In this embodiment, the first-sphere radius of curvature and the second-sphere radius of curvature are the same, and the second-sphere distance is greater than the first-sphere distance. Each grid is preferably made of molybdenum, but it may be made of other operable grid materials as well.

When an ion thruster is started, stopped, or otherwise changed in output power, the grid nearest the plasma changes temperature first, then the second grid changes temperature, then the third grid (if any) changes temperature. As each grid changes temperature, it distorts due to its coefficient of thermal expansion. The axial temperature gradient and consequent varying distortions of the grids potentially lead to a loss in efficiency and even to catastrophic failure by shorting if two grids come into sufficiently close proximity to allow shorting.

A key consideration in the design of the multi-grid structure of the ion-optics system of the ion thruster of the present invention is maintaining the gap clearance dimensions between adjacent grids to a high degree of accuracy, during steady state operations and during transients, regardless of temperature changes, temperature differences between the adjacent grids, thermal gradients, and thermal transients. Loss of efficiency due to changes in the gap between the adjacent grids is minimized, and catastrophic failure resulting from contact shorting of the adjacent grids is avoided. The compound curvature of each grid of the present approach permits the gap between the adjacent grids to be maintained without substantial variation, over a wide range of conditions. This result is achieved because the expansions in the two regions of curvature tend to offset each other. The grid structure is therefore usable in larger sizes, under higher power loads and power densities, and with more demanding operating conditions than heretofore possible such as rapid startup and rampup procedures.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a schematic depiction of an ion thruster;

FIGS. 2A–2B are schematic depictions of two embodiments of the grids of the ion-optics system, wherein FIG. 2A shows two domed grids, and FIG. 2B shows three domed grids;

FIG. 3 is a plan view of one grid; and

DETAILED DESCRIPTION OF THE INVENTION

Figure 2A:
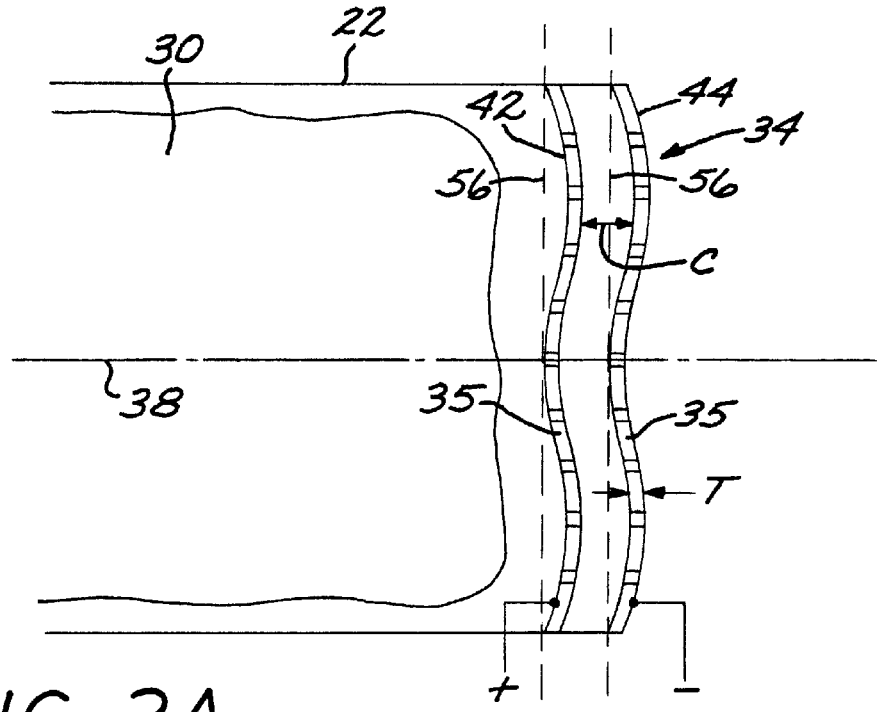

FIG. 1 depicts in general form an ion thruster 20. Ion thrusters are known in the art, except for the modifications and improvements to be discussed herein. See, for example, U.S. Pat. No. 5,924,277. Accordingly, only the basic features of the ion thruster 20 are described here for reference and for establishing the setting of the ion-optics system.

The ion thruster 20 includes a housing 22 having an electron emitter 24 at a first end 26. A propellant gas, such as xenon, from a gas source 28 is injected into the housing 22 at the first end 26. Electrons emitted from the electron emitter 24 ionize the propellant gas, creating a plasma 30 within a central portion of the housing 22. Magnets 32 confine and shape the plasma 30. The electron emitter 24 and the propellant gas introduced into the housing 22 together serve as a source of the plasma 30.

Ions are electrostatically extracted from the plasma 30 by an ion-optics system 34 at a second end 36 of the housing 22 and accelerated out of the housing 22 (to the right in FIG. 1), generally along a thrust axis 38 as an ion beam. The housing 22 is preferably generally cylindrically symmetrical about the thrust axis 38 in the preferred embodiment. The ionic mass accelerated to the right in FIG. 1 drives the housing 22, and the spacecraft to which it is affixed, to the left in FIG. 1. The ionic charge of the ion beam is neutralized by injection of electrons into the ion beam by an electron source 40.

Figure 2B:
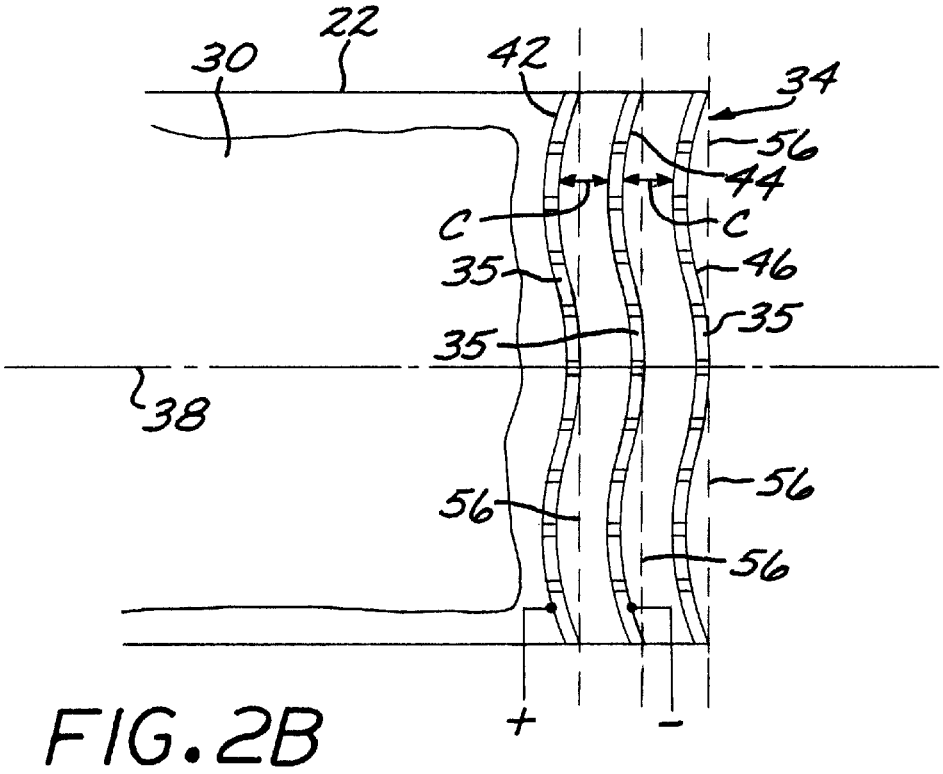

As shown in FIGS. 2A and 2B, the ion-optics system 34 includes at least two grids that selectively extract and accelerate the ions from the plasma 30. Each grid is a solid body with apertures 35 therethrough to permit ions to pass through the apertures. In a two-grid design of FIG. 2A, a screen grid 42 adjacent to the plasma 30 is positively charged. An accelerator grid 44 positioned outwardly of the screen grid 42 is negatively charged. A three-grid design of FIG. 2B includes the same screen grid 42 and accelerator grid 44, but adds a decelerator grid 46 positioned so that the accelerator grid 44 is between the screen grid 42 and the decelerator grid 46. The decelerator grid 46 is maintained at, or very near, zero potential, thereby defining the precise axial location of the neutralization plane.

The grids 42 and 44 are illustrated as domed primarily outwardly relatively to the center of the housing 22, the plasma, and the source of the plasma in FIG. 2A. The grids 42, 44, and 46 are illustrated as domed primarily inwardly relative to the center of the housing 22, the plasma, and the source of the plasma in FIG. 2B. These directions may be reversed, with the two-grid design of FIG. 2A bowed inwardly, and the three-grid design of FIG. 2B bowed outwardly. In either case, the grids of any set are domed in the same direction. The grids 42, 44, and 46 are made of a material that is resistant to the removal of material by physical sputtering during the operation of the ion thruster 20. A preferred material of construction for the grids 42, 44, and 46 is molybdenum, but other materials of construction such as carbon, graphite, pyrolytic graphite, titanium, or columbium may be used as well.

The grids 42, 44, and, where present, 46 are in a facing-but-spaced-apart relationship to each other. Each grid 42, 44, and 46 preferably has the same thickness T and is spaced from the adjacent grid or grids by a clearance distance C. However, in the three-grid design of FIG. 2B, the clearances between the two pairs of grids may be different. In a design of interest to the inventors, T is typically about 0.010 inch thick, and C is about 0.035 inches at room temperature. However, the thickness and clearance may be different in other designs. When the ion thruster 20 is operated, the grids are heated, typically to moderately high temperatures of as high as about 500° C. There may be temperature differences between the grids, particularly during startup or shutdown transient conditions. As the ion thruster 20 is started or its power output changed significantly during operation, there are thermal transients within the set of grids. An important consideration in the efficient operation of the ion thruster 20 is that the clearance distance C between adjacent grids remains approximately constant over a wide range of steady-state and transient ion thruster operating conditions which produce temperature changes, temperature differences between the adjacent grids, thermal gradients, and thermal transients.

Figure 4:
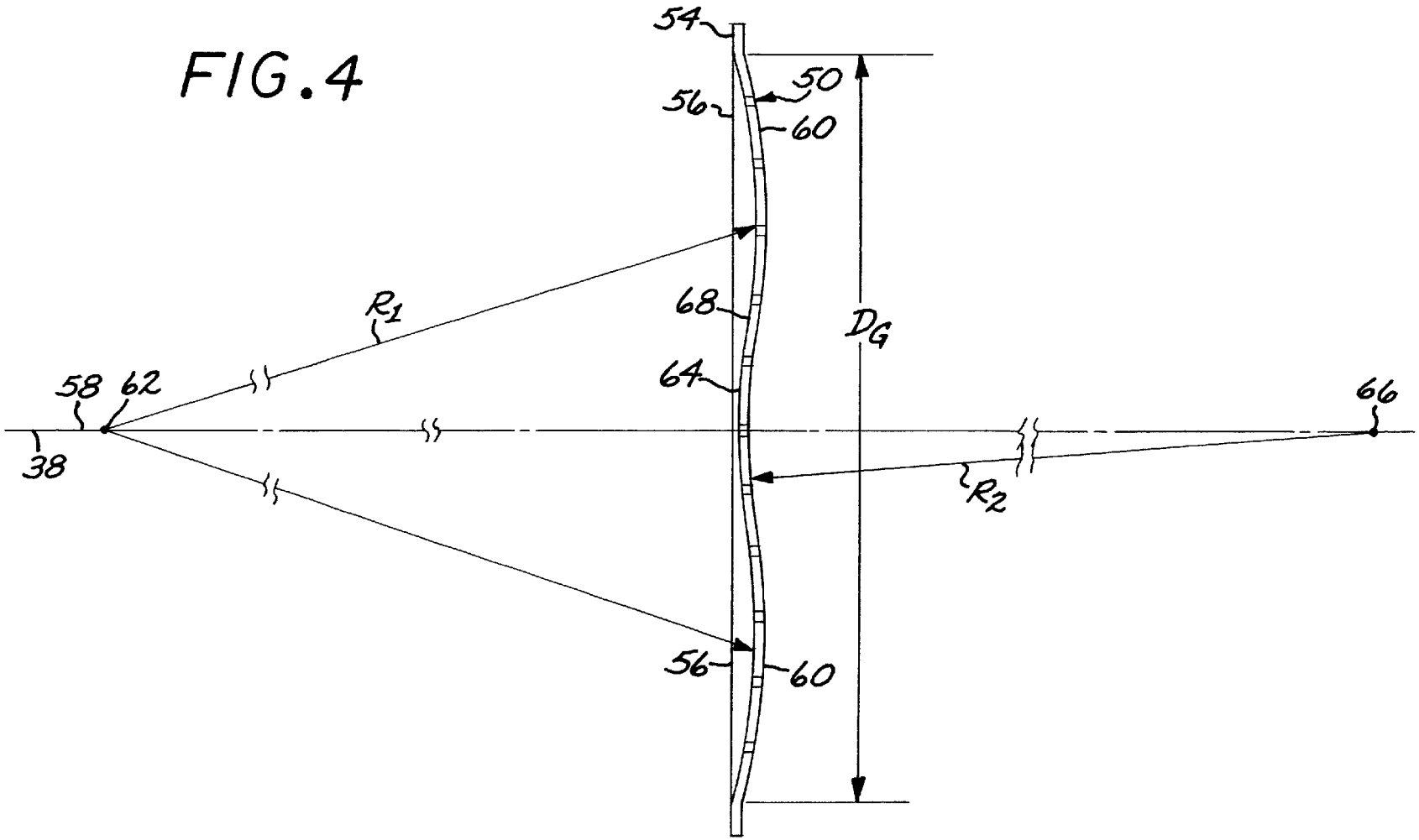
FIG. 4 is a sectional view of the grid of FIG. 3, taken along line 4—4.

FIGS. 3 and 4 illustrate a grid 50 in general form. This form of grid is used for the grids 42, 44, and 46 of FIGS. 2A and 2B, and other grid structures in accordance with the invention. In the design of interest to the inventors, each grid 42, 44, and 46 is axisymmetric about the axis 38 and with a diameter $D_G$, measured in the grid plane, of about 10 inches. A set of mounting ears 52 is provided at the external periphery of the grid 50.

In order to retain the clearances C nearly constant over wide ranges of operating conditions, the grid 50 is shaped with a compound curvature when viewed in the transverse section of FIG. 4 (and FIGS. 2A and 2B for the grids 42, 44, and 46). The grid 50 includes a peripheral region 54 defining a grid plane 56. The grid plane 56 is perpendicular to a grid axis 58 running through the center of the grid 50. The grid axis 58 is coincident with the thrust axis 38 when the grid 50 is mounted to the housing 22.

The grid 50 includes a first region of curvature 60 lying adjacent to and immediately inwardly from the peripheral region 54. The first region of curvature 60 is convexly curved relative to the grid plane 56. Preferably but not necessarily, the first region of curvature 60 is a convexly curved segment of a first sphere relative to the grid plane 56. The first sphere has a first radius-sphere $R_1$ originating from a first-sphere center 62 of the first sphere. The first-sphere center 62 of the first-sphere radius $R_1$ lies along the grid axis 58, and thence along the thrust axis 38 when the grid 50 is assembled to the housing 22.

The grid further includes a second region of curvature 64 lying inwardly toward the grid axis 58 (and thence the thrust axis 38 when the grid 50 is assembled to the housing 22). That is, the first region of curvature 60 lies between the second region of curvature 64 and the peripheral region 54 along the surface of the grid 50. The second region of curvature 64 is concavely curved relative to the grid plane 56. Preferably but not necessarily, the second region of curvature 64 is a convexly curved segment of a second sphere relative to the grid plane 56. The second sphere has a second-sphere radius $R_2$ originating from a second-sphere center 66 of the second sphere. The second-sphere center 66 of the second-sphere radius $R_1$ lies along the grid axis 58, and thence along the thrust axis 38 when the grid 50 is assembled to the housing 22. The second-sphere center 66 is further from the grid plane 56 than the first-sphere center 62.

The curvatures of the first region of curvature 60 and the second region of curvature 64 are smoothly blended together in a curved blended region 68 where they meet. The curved blended region 68 may also be considered a third region of curvature, to the extent that its curvature is different from those of the first region of curvature 60 and the second region of curvature 64. There is no sharp point or feature where the first region of curvature 60 and the second region of curvature 64 meet.

In a preferred design, $R_1$ and $R_2$ are equal in value to each other and to a value R. This configuration defines a primary bowing of the grid off of the grid plane 56 and to the right in the view of FIG. 4. The grid 50 may be used in this orientation, bowed outwardly relative to the center of the housing 22, the grid plane 56, the plasma 30, and the source of the plasma for the grids 42 and 44 of FIG. 2A, or reversed to bow inwardly relative to the center of the housing 22, the grid plane 56, the plasma 30, and the source of the plasma for the grids 42, 44, and 46 of FIG. 2B.

In the preferred embodiment of the grid 50 of most interest to the inventors, DG is about 10 inches, T is about 0.010 inch, C is about 0.035 inch at room temperature when the grids are assembled together, R, $R_1$, and $R_2$ are each about 20 inches, and the blended region (third region of curvature) 68 has a radius of curvature of about 1 inch. These dimensions are presented as illustrative of a preferred embodiment. These dimensions are not to be taken as limiting of the invention in any respect, and the invention is not so limited. However, it has been found that the grid 50 is particularly useful when $R/D_G$ is about 2/1, as in this preferred design.

This compound curvature configuration for the grids results in greater dimensional stability of the ion optics system 34 during both steady-state and transient operations. Studies have shown that the spacing between the grids remains more nearly constant under a wide variety of steady-state and transient conditions. It is therefore possible to operate the ion thruster at higher power levels and with more rapid changes in power (steeper transients) than possible with simply curved grids, without reduction in efficiency and without catastrophic failure due to shorting.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An ion thruster, comprising:

a source of a plasma; and an ion-optics system located in sufficient proximity to the source of the plasma to extract ions therefrom along a thrust axis, the ion-optics system comprising at least two grids arranged in a facing-but-spaced-apart relationship to each other, each grid comprising a peripheral region defining a grid plane perpendicular to the thrust axis, a first region of curvature adjacent to the peripheral region, the first region of curvature being convexly curved relative to the grid plane, and a second region of curvature along the thrust axis such that the first region of curvature lies between the second region of curvature and the peripheral region, the second region of curvature being concavely curved relative to the grid plane.

2. The ion thruster of claim 1, wherein the first region of curvature is a segment of a first sphere.

3. The ion thruster of claim 1, wherein the second region of curvature is a segment of a second sphere.

4. The ion thruster of claim 1, wherein the first region of curvature is a segment of a first sphere and the second region of curvature is a segment of a second sphere.

5. The ion thruster of claim 1, wherein the first sphere and the second sphere have substantially the same radius of curvature R, wherein each grid has a diameter $D_G$ measured in the grid plane, and wherein $R/D_G$ is about 2/1.

6. The ion thruster of claim 1, wherein each grid further comprises a third region of curvature lying between the first region of curvature and the second region of curvature.

7. The ion thruster of claim 1, wherein the first region of curvature is bowed outwardly relative to the grid plane.

8. The ion thruster of claim 1, wherein the first region of curvature is bowed inwardly relative to the grid plane.

9. The ion thruster of claim 1, wherein there are exactly two grids.

10. The ion thruster of claim 1, wherein there are exactly three grids.

11. The ion thruster of claim 1, wherein each grid further comprises:

at least two mounting ears affixed to the peripheral region of the grid at a location remote from the first region of curvature.

12. An ion thruster, comprising:

a source of a plasma; and an ion-optics system located in sufficient proximity to the source of the plasma to extract ions therefrom, the ion-optics system comprising at least two grids arranged in a facing-but-spaced-apart relationship to each other, each grid being axisymmetric about a grid axis and comprising a peripheral region defining a grid plane perpendicular to the grid axis, a first region of curvature adjacent to the peripheral region, the first region of curvature being a convexly curved segment of a first sphere relative to the grid plane, and a second region of curvature along the grid axis such that the first region of curvature lies between the second region of curvature and the peripheral region, the second region of curvature being a concavely curved segment of a second sphere relative to the grid plane.

13. The ion thruster of claim 12, wherein each grid has a diameter measured in the grid plane of $D_G$, the first-sphere radius of curvature is R, and the ratio $R/D_G$ is about 2/1.

14. The ion thruster of claim 12, wherein each grid further comprises a third region of curvature lying between the first region of curvature and the second region of curvature.

15. The ion thruster of claim 12, wherein there are exactly two grids.

16. The ion thruster of claim 12, wherein there are exactly three grids.

17. The ion thruster of claim 12, wherein the first region of curvature is bowed outwardly relative to the grid plane.

18. The ion thruster of claim 12, wherein the first region of curvature is bowed inwardly relative to the grid plane.

* * * * *